US012448100B1

(12) United States Patent
Heino

(10) Patent No.: US 12,448,100 B1
(45) Date of Patent: Oct. 21, 2025

(54) PROPULSION UNIT FOR A WATERBORNE VESSEL

(71) Applicant: Superstream OY, Helsinki (FI)

(72) Inventor: Harri Heino, Helsinki (FI)

(73) Assignee: Superstream OY, Helsinki (FI)

( * ) Notice: Subject to any disclaimer, the term of this patent is extended or adjusted under 35 U.S.C. 154(b) by 0 days.

(21) Appl. No.: 19/030,633

(22) Filed: Jan. 17, 2025

(51) Int. Cl.
*B63H 21/17* (2006.01)
*B63H 1/14* (2006.01)

(52) U.S. Cl.
CPC ..... *B63H 21/17* (2013.01); *B63H 1/14* (2013.01)

(58) Field of Classification Search
CPC ..... B63H 21/17; B63H 1/14
See application file for complete search history.

(56) References Cited

U.S. PATENT DOCUMENTS

| | | | | |
|---|---|---|---|---|
| 3,796,514 | A * | 3/1974 | DuFrene | B64D 35/00 416/169 R |
| 4,009,677 | A * | 3/1977 | Croisant | B63H 20/007 440/6 |
| 11,485,457 | B1 * | 11/2022 | Montague | B63H 5/165 |
| 2022/0345001 | A1 | 10/2022 | Sundberg et al. | |

FOREIGN PATENT DOCUMENTS

| | | | |
|---|---|---|---|
| EP | 1826888 | A1 | 8/2007 |
| EP | 2762402 | A1 | 8/2014 |
| EP | 3604117 | A1 | 2/2020 |

* cited by examiner

*Primary Examiner* — Stephen P Avila

(74) *Attorney, Agent, or Firm* — Harness, Dickey & Pierce, P.L.C.

(57) ABSTRACT

A propulsion unit for a waterborne vessel comprises: an electrically powered outrunner motor having a stator and a rotor, the rotor being configured for rotation around the stator about a stator axis; a plurality of propeller blades fixed to the rotor for rotation therewith about said stator axis; first and second components forming part of or being fixed to the stator, the first and second components being spaced apart along said stator axis with the rotor being located axially between the first and second components; a first rotary seal located between the first component and an opposed first end surface of the rotor; and a second rotary seal located between the second component and an opposed second end surface of the rotor, wherein the first and second rotary seals are configured to substantially prevent the ingress of water into a rotor-stator gap.

16 Claims, 5 Drawing Sheets

PROPULSION UNIT FOR A WATERBORNE VESSEL

TECHNICAL FIELD

The present invention relates to a propulsion unit for a waterborne vessel, and in particular to an electrically powered propulsion unit comprising an outrunner motor.

BACKGROUND

Whilst propulsion units for waterborne vessels have typically relied upon internal combustion engines, there is increasing interest in and use of electrically powered motors. An example propulsion unit having an electrically powered motor is an electric outboard, such as might be used on a motor boat used for fishing as an auxiliary means of propulsion at low speeds. With advances in battery technology, there are several companies offering high power electric outboards (e.g. +100 hp) which make use of a vertical shaft to transfer power from a horizontal output shaft of a motor to a horizontal propeller shaft, via an intervening transmission system. However, having an electric motor on a separate shaft leads to efficiency losses due to the transmission of mechanical power from the motor to the propeller, as well as excess noise.

An alternative to the conventional outboard is a propulsion unit that is essentially self-contained and is mounted to the vessel's hull, either in a traditional outboard configuration or directly beneath the hull, i.e. the unit receives no mechanical energy from within the hull, only electrical power, e.g. from on-board batteries. The output shaft of the electrically powered motor is mechanically coupled to a propeller. The orientation of self-contained propulsion units, or "pods", may be adjustable to provide steering for the vessel, such that a conventional rudder may not be required.

EP3604117A1 describes a propulsion unit comprising an outboard waterjet, wherein a nacelle houses a propeller for generating a flow of fluid through the nacelle from an intake to a discharge nozzle. An electric motor operatively connected to the propeller may be provided within the nacelle. The large diameter of such self-contained propulsion units can however cause large amounts of hydrodynamic drag. In addition, due to the long thermal conduction distance from the interior of the motor to the surrounding water, it may be challenging to dissipate the heat generated within the motor.

US2022/0345001A1 describes an electric motor with an intrinsic cooling system comprising a channel arranged between a moulded rotor and a moulded stator to allow water from the surrounding environment to pass through and cool the internal part of the rotor that faces the stator.

EP1826888A1 describes an electrical outboard motor with an external rotor motor and integrated electronic converter.

EP2762402A1 describes a boat propeller arrangement comprising a stator and a rotor arranged within each other around the propeller hub, on the outer surface of which rotor propeller blades are provided, wherein a tunnel is created through the propeller hub to allow water to flow through the tunnel for cooling the motor.

SUMMARY

According to a first aspect of the disclosure, there is provided a propulsion unit for a waterborne vessel, the propulsion unit comprising an electrically powered outrunner motor having a stator and a rotor, the rotor being configured for rotation around the stator about a stator axis, a plurality of propeller blades fixed to the rotor for rotation therewith about said stator axis, first and second components forming part of or being fixed to the stator, the first and second components being spaced apart along said stator axis with the rotor being located axially between the first and second components, a first rotary seal located between the first component and an opposed first end surface of the rotor, and a second rotary seal located between the second component and an opposed second end surface of the rotor. The first and second rotary seals are configured to substantially prevent the ingress of water into a rotor-stator gap.

In embodiments, at least one of the rotary seals may comprise a pair of rotary seal subassemblies separated by a plurality of ball bearings, wherein the rotary seal subassemblies are respectively secured to the rotor and one of the first and second components. The purpose of the sealing is to keep the water out of the cavity between the rotor and the stator. The term "ball bearing" as used herein may be considered to refer to bearing balls (i.e. balls for use in ball-type bearings).

In embodiments, the plurality of ball bearings may be held in respective holes of a ball bearing spacer ring, such that the ball bearings protrude on either side of said ball bearing spacer ring.

In embodiments, the rotary seal subassemblies may comprise respective opposing ball bearing rings configured to provide respective opposing glide surfaces for the plurality of ball bearings.

In embodiments, the opposing ball bearing rings may comprise respective opposing first annular channels that together define an annular space that accommodates the plurality of ball bearings between the respective opposing glide surfaces.

In embodiments, at least one of the rotary seal subassemblies may further comprise an annular gasket ring provided between the opposing ball bearing rings and located radially outwards from the corresponding first annular channel to prevent the ingress of water into the annular space.

In embodiments, one of the pair of opposing bearing rings may comprise a second annular channel facing the opposing bearing ring and located radially outwards of the first annular channel, wherein a portion of the annular gasket ring is provided within said second annular channel.

In embodiments, a resilient biasing ring may be located between the gasket ring and one of the pair of opposing bearing rings, the biasing ring configured to apply a force to the gasket ring in the direction of the opposing ball bearing ring.

In embodiments, one of the pair of opposing bearing rings may comprise a second annular channel facing the opposing bearing ring and located radially outwards of the first annular channel, wherein the resilient biasing ring is provided within said second annular channel.

In embodiments, the first component may be formed integrally with the stator.

In embodiments, the second component may be formed separately from and may be fixed to the stator, optionally by a threaded connection.

In embodiments, respective external surfaces of the first component, the rotor, and the second component, adjacent to the rotary seals, may be substantially flush with one another.

In embodiments, the stator may define a central passageway extending axially through the stator and which is open at both ends, and the first and second components may each define passageways in fluid communication with said central passageway through the stator such that a continuous passageway extends across the axial extent of the propulsion unit.

In embodiments, the first component may be configured for mounting the propulsion unit to the vessel.

In embodiments, a leading end of the first stationary component may be tapered.

In embodiments, a trailing end of the second stationary component may be tapered.

According to a second aspect of the disclosure, there is provided a waterborne vessel comprising one or more propulsion units as described herein.

According to a third aspect of the disclosure, there is provided a rotary seal for use in a propulsion unit for a waterborne vessel. In use, the rotary seal may be located between two opposed components of the propulsion unit, in order to substantially prevent the ingress of water between the two components whilst permitting relative rotation of said components.

In embodiments, the rotary seal may be located, in use, between a stationary component forming part of or being fixed to a stator and an opposed end surface of a rotor (e.g. of a outrunner motor).

In embodiments, the rotary seal may comprise a pair of rotary seal subassemblies separated by a plurality of ball bearings, wherein the subassemblies are respectively secured to the two opposed components of the propulsion unit.

In embodiments, the plurality of ball bearings may be held in respective holes of a ball bearing spacer ring, such that the ball bearings protrude on either side of said ball bearing spacer ring.

In embodiments, the rotary seal subassemblies may comprise respective opposing ball bearing rings configured to provide respective opposing glide surfaces for the plurality of ball bearings.

In embodiments, the opposing ball bearing rings may comprise respective opposing first annular channels that together define an annular space that accommodates the plurality of ball bearings between the respective opposing glide surfaces.

In embodiments, at least one of the rotary seal subassemblies may further comprise an annular gasket ring provided between the opposing ball bearing rings and located radially outwards from the corresponding first annular channel to prevent the ingress of water into the annular space.

In embodiments, one of the pair of opposing bearing rings may comprise a second annular channel facing the opposing bearing ring and located radially outwards of the first annular channel, wherein a portion of the annular gasket ring is provided within said second annular channel.

In embodiments, a resilient biasing ring may be located between the gasket ring and one of the pair of opposing bearing rings, the biasing ring configured to apply a force to the gasket ring in the direction of the opposing ball bearing ring.

In embodiments, one of the pair of opposing bearing rings may comprise a second annular channel facing the opposing bearing ring and located radially outwards of the first annular channel, wherein the resilient biasing ring is provided within said second annular channel.

According to a fourth aspect of the disclosure, there is provided a waterborne vessel comprising a propulsion unit, said propulsion unit comprising one or more rotary seals as described herein.

DETAILED DESCRIPTION

Figure 1:
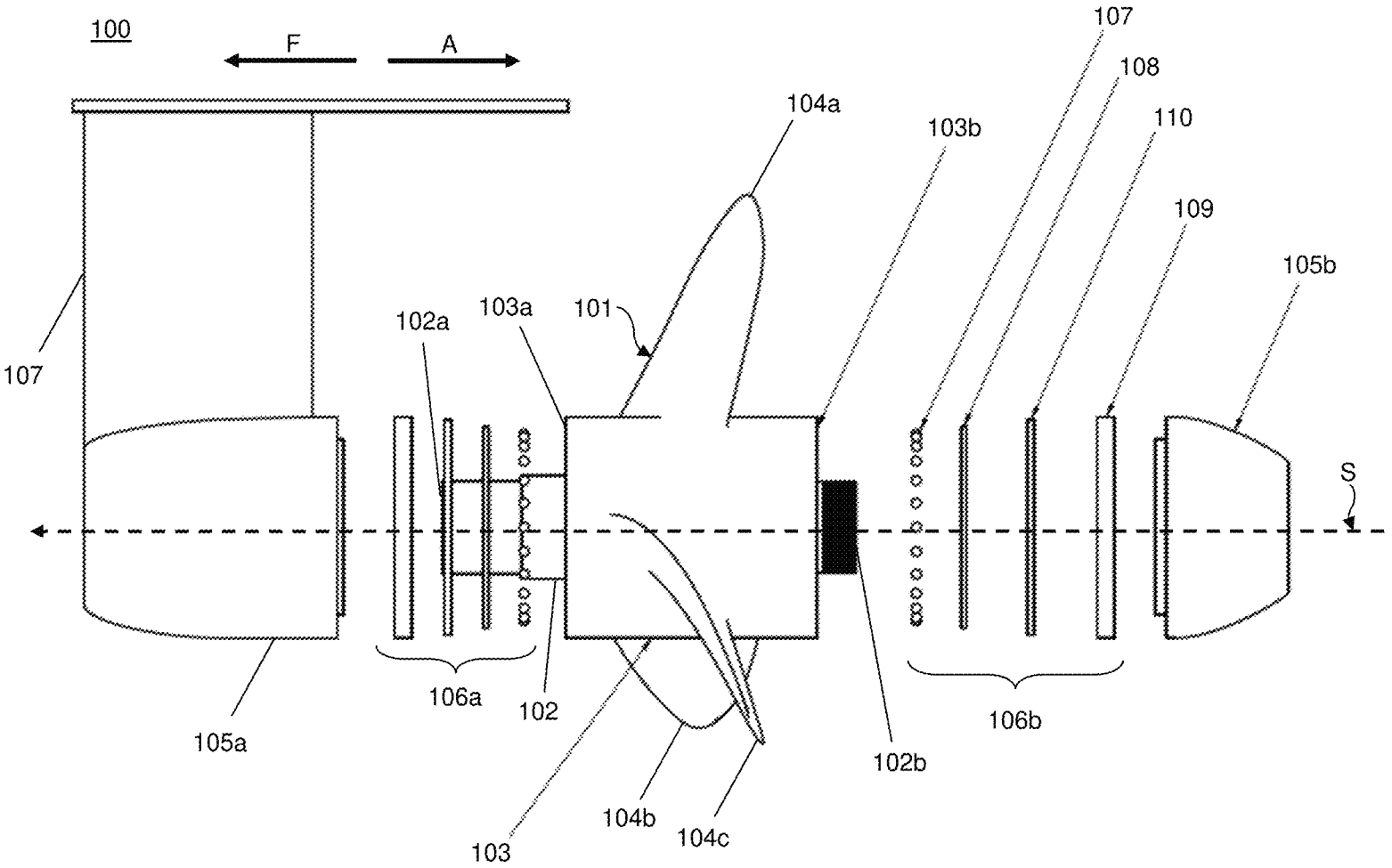
FIG. 1 shows schematically a side exploded view of a propulsion unit according to the present disclosure.

FIG. 1 shows schematically a side exploded view of a propulsion unit 100 according to the present disclosure. The propulsion unit 100 comprises an electrical outrunner motor 101 comprising a stator 102 and a rotor 103, the rotor being configured for rotation around a portion of the stator about a stator axis S. The motor may be of any suitable type, e.g. a permanent magnet motor with permanent magnets on the rotor and excitation windings on the stator or a synchronous motor with excitation windings on both the stator and the rotor.

An external surface of the rotor 103 is provided with a plurality of propeller blades 104*a*, 104*b*, 104*c* that are mounted to or formed integrally with the rotor. By using the rotor 103 itself as a base for the propeller blades, the motor can be constructed more simply and robustly.

The propulsion unit 100 comprises first and second components 105*a*, 105*b* that form part of or are fixed to the stator 102, such that the first and second components are stationary relative to the stator when the propulsion unit is in use (i.e. such that the first and second components do not rotate with the rotor 103). The first and second stationary components 105*a*, 105*b* are spaced apart along the stator axis S, with the rotor 103 being located axially in between. The first stationary component 105*a*, located towards a forward side (F) of the propulsion unit 100 in the primary direction of travel, is configured for mounting the motor 101 to a waterborne vessel such as a boat (not shown), for example via a mounting bracket 107. As shown in the Figure a leading end of the first stationary component 105*a* may be tapered, or the first stationary component may be otherwise shaped in order to reduce hydrodynamic drag. The second stationary component 105*b*, located towards an aft side (A) of the propulsion unit 100, is supported by its connection to the stator 102. As shown in the Figure, a trailing end of the second stationary component 105*b* may be tapered, or the second stationary component may be otherwise shaped in order to reduce hydrodynamic drag.

As will be apparent from the following discussion, the unit is configured to provide a central passageway or channel that extends axially along the full length of the unit to allow the flow of water through the unit.

As described above, the first and second components 105*a*, 105*b* either form part of or are fixed to the stator 102. For example, one or both of the first and second stationary components 105*a*, 105*b* may be respectively fixed to first and second opposite ends 102*a*, 102*b* of the stator 102 by any suitable fixing (not shown), such as a threaded connection. In one example, a male thread (e.g. a fine thread) is provided on the second end of the stator 102*b*, and a corresponding female thread is provided on the second stationary component 105*b* (or vice versa). A similar or different connection may be provided between the first end of the stator 102*a* and the first stationary component 105*a*, or the stator and first stationary component may be integrally formed. Where a threaded connection is used, additional locking means may be provided to ensure that the connection does not become loosened or overtightened (e.g. due to torque or vibration from the motor 101 when in use). In one example the first (forward) stationary component 105*a* may be formed integrally with the stator 102, and the second (aft) stationary component 105*b* may be fixed to the opposite end 102*b* of the stator 102 during manufacture (e.g. once the rotor 103 has been located around the central portion of the stator 102 about which it is configured to rotate).

The first and second stationary components 105*a*, 105*b* are also coupled to opposite ends 103*a*, 103*b* of the rotor 103 by respective first and second rotary seal arrangements 106*a*, 106*b*. That is, a first rotary seal 106*a* is located between the first component 105*a* and an opposed end 103*a* of the rotor 103, and a second rotary seal 106*b* is located between the second component and an opposed end 103*b* of the rotor.

As shown in FIG. 1, the first and second rotary seals 106*a*, 106*b* may be structurally identical and installed as mirror images of one another. As described in more detail below, the rotary seals 106*a*, 106*b* each comprise a plurality of ball bearings 107 located within respective holes of a ball bearing spacer ring 108, and located between a rotor-side bearing ring (not shown) and a stationary component-side (or "stator-side") bearing ring 109. A gasket 110 is provided to prevent the ingress of water, salt and dirt through the rotary seal 106*a*, 106*b* and into the rotor-stator gap. By providing rotary seals 106*a*, 106*b* at both ends of the rotor 103, between the rotor end faces 103*a*, 103*b* and the opposed stationary components 105*a*, 105*b* which are fixed to the stator 102, not only is the ingress of water, salt and dirt into the rotor-stator gap prevented, the entire mechanism is made more stable and less susceptible to vibration.

Figure 2:
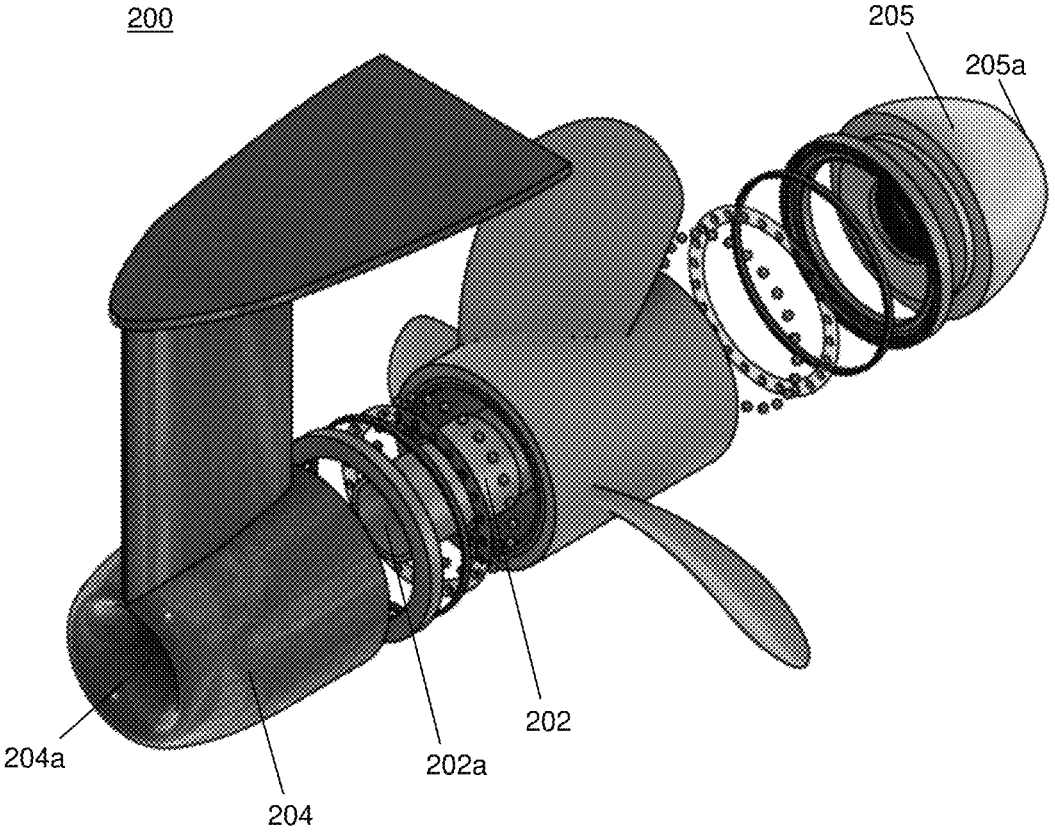
FIG. 2 shows schematically a perspective exploded view of a propulsion unit according to the present disclosure.

FIG. 2 shows schematically a perspective exploded view of a propulsion unit 200 for the purposes of further explanation, having a generally similar construction to that of the unit illustrated in FIG. 1. As shown in the Figure, the stator 202 defines a central passageway 202*a* extending axially through the stator body and which is open at both ends. The first stationary component 204 and the second stationary component 205 each define passageways 204*a*, 205*a* in fluid communication with the central passageway 202*a* through the stator 202 such that, once assembled, a continuous passageway extends across the entire axial extent of the propulsion unit 200. In use, this arrangement allows for surrounding water to freely flow through the propulsion unit 200 including the interior of the stator 202 to provide cooling for the stator. In particular, this arrangement allows for the thermal conduction distance from the interior of the motor to the external environment to be reduced, leading to improved cooling. In addition, by providing a continuous fluid channel through the motor in the direction of travel, the drag caused by the structure of the motor is reduced, resulting in improved performance and efficiency of a vessel.

Figure 3:
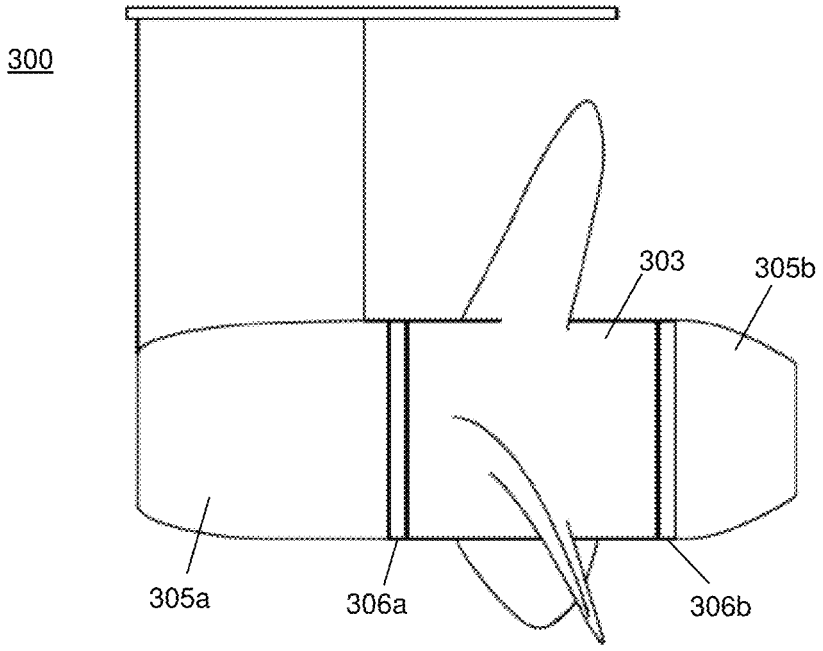
FIG. 3 shows schematically a side view of an assembled propulsion unit according to the present disclosure.

FIG. 3 shows schematically a side view of an assembled propulsion unit 300 according to the present disclosure (e.g. as shown in FIG. 1), with the rotor 303 and the first and second stationary components 305*a*, 305*b* shown. As shown in the Figure, the external surfaces of the first component 305*a*, the rotor 303, and the second component 305*b*, adjacent to the rotary seals 306*a*, 306*b*, are substantially flush with one another. Hydrodynamic drag is thereby reduced.

Figure 4:
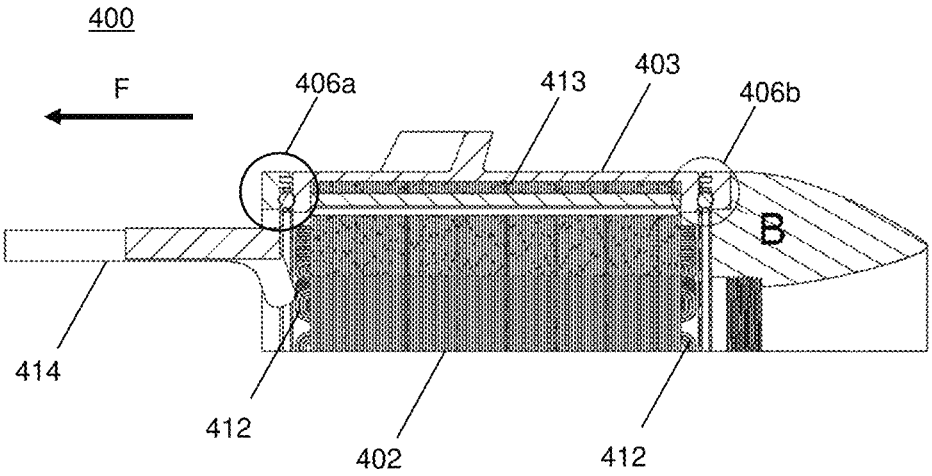
FIG. 4 shows schematically a side cross-sectional view of a part of a propulsion unit according to the present disclosure.

FIG. 4 shows schematically a side cross-sectional view of a part of a propulsion unit 400 according to the present disclosure (e.g. as shown in FIG. 1), with rotary seals 406*a*, 406*b* shown. The stator 402 comprises a plurality of conductive coils forming one or more windings 412, each coil being wound around a corresponding stator tooth, where the stator teeth are angularly spaced around an outer surface of the stator and extend radially from said outer surface and parallel to the stator axis. The rotor 403 comprises a plurality of permanent magnets 413 angularly spaced around the inner circumference of the rotor and extending parallel to the stator axis. In use, rotating electromagnetic fields are generated by the stator coils 412, which interact with permanent magnetic fields of the rotor magnets 413. This interaction generates a torque such that the rotor 403 rotates around the stator 402 about the stator axis S, causing the propellers 404*a*, 404*b*, 404*c* to propel the vessel in the forward direction F. Of course the propulsion direction may be reversed by reversing the rotational direction of the rotating electromagnetic fields. Also shown in the Figure are one or more cables 414 for providing current to the stator coils.

Figure 5:
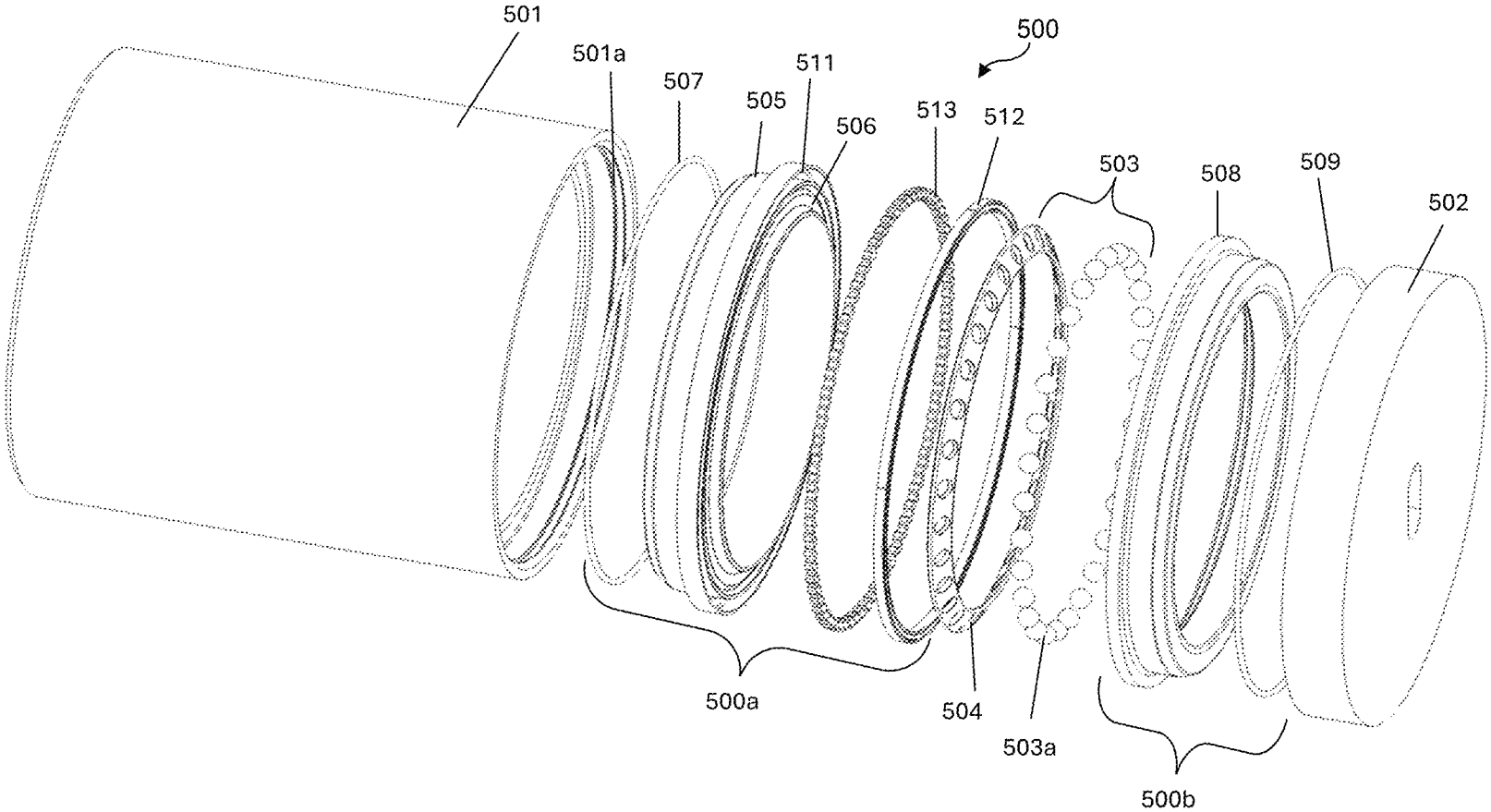
FIG. 5 shows schematically an axially exploded perspective view of components providing a rotary seal within a propulsion unit according to the present disclosure.
Figure 6:
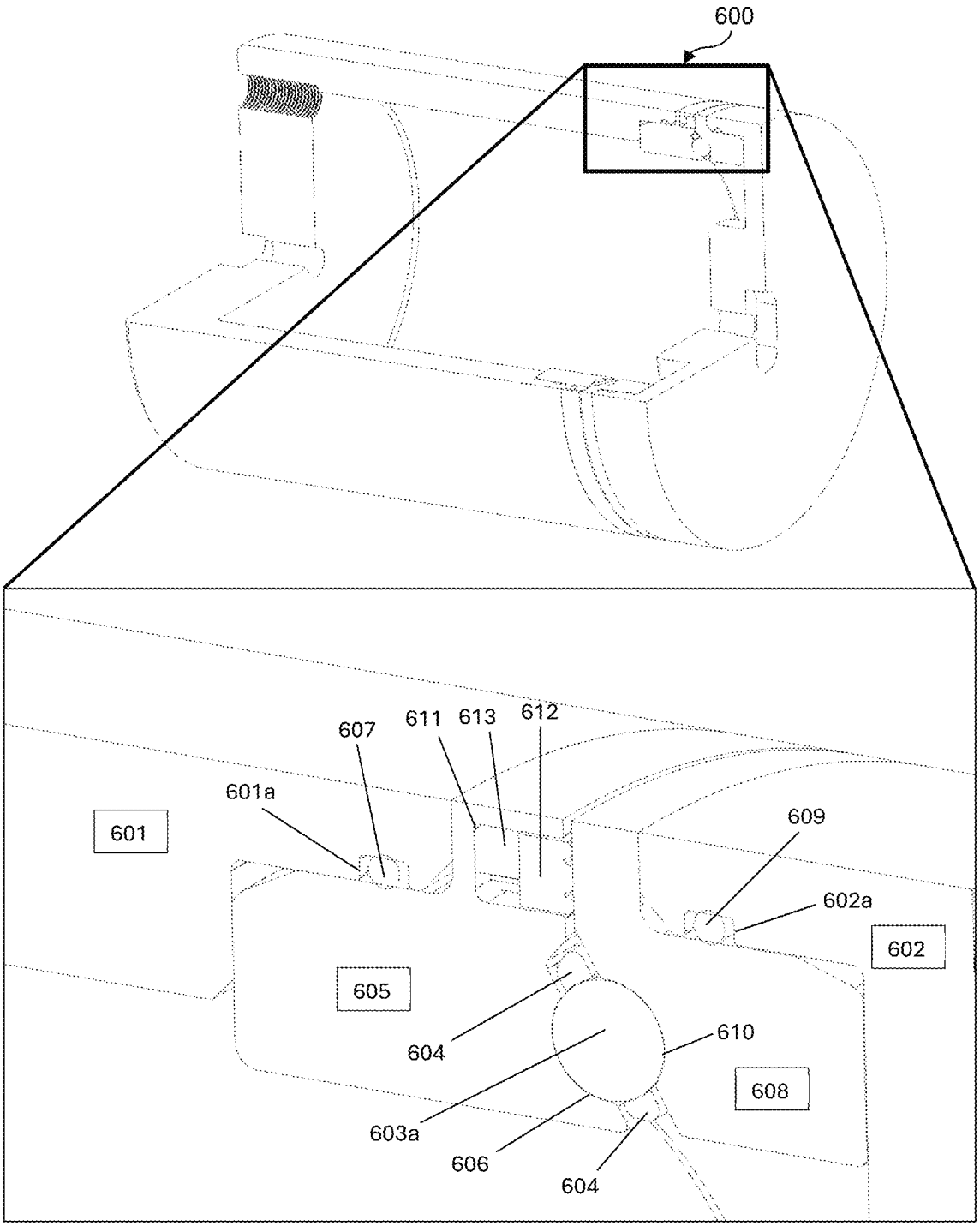
FIG. 6 shows schematically a cut-away cross-sectional view of a part of a propulsion unit according to the present disclosure and detail of the same.

FIG. 5 shows schematically an axially exploded view of a rotary seal 500 for use in a propulsion unit according to the present disclosure (e.g. as shown in FIG. 1), whilst FIG. 6 shows a cut-away cross-sectional view of a corresponding seal 600 within a propulsion unit when assembled. The rotary seal 500, 600 depicted is that between the first (forward) stationary component 501, 601 and the rotor 502, 602. The same arrangement may be provided (e.g. in a mirrored configuration) between the rotor 502, 602 and the second (aft) stationary component (not shown).

The rotary seal 500, 600 comprises a pair of opposing rotary seal subassemblies 500*a*, 500*b*. A first (stator-side) subassembly 500*a* is secured to an end of the stationary component 501, 601 and a second (rotor-side) subassembly 500*b* is secured to an end of the rotor 502, 602. The pair of opposing subassemblies 500*a*, 500*b* are separated by a ball bearing structure 503 comprising a plurality of ball bearings 503*a*, 603*a*. The ball bearings 503*a*, 603*a* are held within respective holes of a ball bearing spacer ring 504, 604 and protrude on both sides thereof (as shown in FIG. 6).

Each of the subassemblies 500*a*, 500*b* comprises a bearing ring 505, 508, 605, 608. The bearing ring 505, 605 of the stator-side subassembly 500*a* is seated within an end of the stationary component 501, 601, and is secured in place by an elastomeric O-ring 507, 607 that is located within an annular recess 501*a*, 601*a* provided around an internal surface of the stationary component 501, 601. The bearing ring 508, 608 of the rotor-side subassembly 500*b* is similarly seated within an end of the rotor 502, 602, and is secured in place by an elastomeric O-ring 509, 609 that is located within an annular recess 602*a* provided around an internal surface of the rotor 502, 602. A first annular channel 506, 606 is provided in an end of the stator-side bearing ring 505, 605 facing the rotor 502, 602, and a corresponding first annular channel 610 is provided in an end of the rotor-side bearing ring 508, 608 facing the stationary component 501, 601. The stator-side bearing ring 505, 605 also comprises a second annular channel 511, 611 provided radially outside of the first annular channel 506, 606. Within the second annular channel 511, 611, a gasket ring 512, 612 and a resilient biasing ring 513, 613 are provided.

The respective first annular channels 606, 610 of the opposing bearing rings 505, 508, 605, 608 together define an annular space that accommodates the plurality of ball bearings 503*a*, 503*b* between respective opposing glide surfaces of the bearing rings. The biasing ring 513, 613 is configured to apply a force to the gasket ring 512, 612 in the direction of the rotor-side bearing ring 508, 608, to actively prevent water and the like from passing between the gasket ring and the rotor-side bearing ring. The biasing ring 513, 613 is also configured to prevent rotational slippage of the gasket ring 512, 612 in relation to the stator-side bearing ring 505, 605. The interface between the stator-side bearing ring 505, 605 and the rotor-side bearing ring 508, 608 is therefore isolated from the surrounding seawater by the gasket ring 512, 612 and may be occupied by air or a lubricating fluid such as oil.

The skilled person will appreciate (e.g. from the structure of the propulsion unit as a whole as illustrated in FIGS. 1 to 4) that the components of the rotary seals 500, 600 shown in FIGS. 5 and 6 will be held securely together between the first and second stationary components in the assembled propulsion unit (e.g. by virtue of the first and second stationary components forming part of, or being fixed to, the stator).

The rotor 502, 602 and the first/second components 501, 601 may be formed of any suitable material such as stainless steel, aluminum or a suitable composite material. The ball bearings 503, 603 and the bearing rings 505, 508, 605, 608 may be formed of stainless steel or ceramic, and surface treatments and coatings may also be applied to reduce friction or to provide improved resistance to corrosion and wear. The O-rings 507, 509, 607, 609 and biasing ring 513, 613 may be formed of sea-water resistant elastomers such as silicone, neoprene rubber, PTFE based elastomers, and epoxy based elastomers. Suitable materials for the gasket ring 512, 612 include PTFE based materials, PEEK based materials, and composite materials (e.g. with a graphite or carbon filling).

It will be appreciated by the person skilled in the art that various modifications may be made to the specific examples described above. In particular, the term "outrunner motor" as used herein may be considered to refer to any suitable arrangement for an electric motor whereby a rotor is located external to and rotatably about a stator. In addition, although the examples above describe the use of rotary seals comprising ball bearings, a sliding bearing, a roller bearing or a needle bearing could alternatively be used.

The invention claimed is:

1. A propulsion unit for a waterborne vessel, the propulsion unit comprising:

an electrically powered outrunner motor having a stator and a rotor, the rotor being configured for rotation around the stator about a stator axis;

a plurality of propeller blades fixed to the rotor for rotation therewith about said stator axis;

first and second components forming part of or being fixed to the stator, the first and second components being spaced apart along said stator axis with the rotor being located axially between the first and second components;

a first rotary seal located between the first component and an opposed first end surface of the rotor; and a second rotary seal located between the second component and an opposed second end surface of the rotor, wherein the first and second rotary seals are configured to substantially prevent ingress of water into a rotor-stator gap, wherein at least one of the first and second rotary seals comprises a pair of rotary seal subassemblies separated by a plurality of ball bearings, wherein the rotary seal subassemblies are respectively secured to the rotor and one of the first and second components, and wherein the rotary seal subassemblies comprise respective opposing ball bearing rings configured to provide respective opposing glide surfaces for the plurality of ball bearings.

2. The propulsion unit of claim 1, wherein the plurality of ball bearings are held in respective holes of a ball bearing spacer ring, such that the ball bearings protrude on either side of said ball bearing spacer ring.

3. The propulsion unit of claim 1, wherein the opposing ball bearing rings comprise respective opposing first annular channels that together define an annular space that accommodates the plurality of ball bearings between the respective opposing glide surfaces.

4. The propulsion unit of claim 3, wherein at least one of the rotary seal subassemblies further comprises an annular gasket ring provided between the opposing ball bearing rings and located radially outwards from the corresponding first annular channel to prevent e-ingress of water into the annular space.

5. The propulsion unit of claim 4, wherein one of the pair of opposing bearing rings comprises a second annular channel facing the opposing bearing ring and located radially outwards of the first annular channel, and wherein a portion of the annular gasket ring is provided within said second annular channel.

6. The propulsion unit of claim 4, wherein a resilient biasing ring is located between the gasket ring and one of the pair of opposing bearing rings, the biasing ring configured to apply a force to the gasket ring in a direction of the opposing ball bearing ring.

7. The propulsion unit of claim 6, wherein one of the pair of opposing bearing rings comprises a second annular channel facing the opposing bearing ring and located radially outwards of the first annular channel, and wherein the resilient biasing ring is provided within said second annular channel.

8. The propulsion unit of claim 1, wherein the first component is formed integrally with the stator.

9. The propulsion unit of claim 1, wherein the second component is formed separately from and is fixed to the stator.

10. The propulsion unit of claim 1, wherein respective external surfaces of the first component, the rotor, and the second component, adjacent to the rotary seals, are substantially flush with one another.

11. The propulsion unit of claim 1, wherein the stator defines a central passageway extending axially through the stator and which is open at both ends, and wherein the first and second components each define passageways in fluid communication with said central passageway through the stator such that a continuous passageway extends across an axial extent of the propulsion unit.

12. The propulsion unit of claim 1, wherein the first component is configured for mounting the propulsion unit to the vessel.

13. The propulsion unit of claim 1, wherein a leading end of the first component is tapered.

14. The propulsion unit of claim 1, wherein a trailing end of the second component is tapered.

15. A waterborne vessel comprising one or more propulsion units according to claim 1.

16. The propulsion unit of claim 9, wherein the second component is fixed to the stator by a threaded connection.

* * * * *